US008875459B2

(12) United States Patent
Palmeri

(10) Patent No.: US 8,875,459 B2
(45) Date of Patent: Nov. 4, 2014

(54) MODULAR BUILDING SYSTEM

(76) Inventor: Richard Palmeri, North Palm Beach, FL (US)

( * ) Notice: Subject to any disclaimer, the term of this patent is extended or adjusted under 35 U.S.C. 154(b) by 588 days.

(21) Appl. No.: 12/803,976

(22) Filed: Jul. 12, 2010

(65) Prior Publication Data

US 2012/0005971 A1 Jan. 12, 2012

(51) Int. Cl.

| | |
|---|---|
| ***E04B 1/00*** | (2006.01) |
| ***E04B 5/00*** | (2006.01) |
| ***E04B 7/00*** | (2006.01) |
| ***E04B 2/74*** | (2006.01) |
| ***E04B 7/04*** | (2006.01) |
| *E04B 1/24* | (2006.01) |

(52) U.S. Cl.

CPC ..... *E04B 2/7407* (2013.01); *E04B 1/24* (2013.01); *E04B 2001/249* (2013.01); *E04B 2001/2481* (2013.01); *E04B 2001/2466* (2013.01); *E04B 2001/2463* (2013.01); *E04B 7/04* (2013.01)

USPC ..... 52/274; 52/293.3; 52/774; 52/745.05

(58) Field of Classification Search

CPC ..... E04B 1/04; E04B 1/40; E04B 1/61; E04B 1/6104; E04B 1/6125; E04B 2/00; E04B 2/56; E04B 2/58; E04B 2/64; E04B 2/66; E04B 2/76; E04B 2/88; E04B 2/90; E04B 2/92; E04B 2/94; E04B 2/7407; E04B 2/7409; E04B 2/7457; E04C 2/52; E04C 2/521; E04C 2/523; E04C 2/525; E02D 27/00; E02D 27/01; E02D 27/02; E02D 27/32; E04H 9/02; E04H 9/024; Y10S 52/03

USPC ..... 52/292, 293.1, 293.3, 294, 274, 281, 52/285.1, 716.1, 716.8, 718.01, 731.5, 52/731.9, 733.2, 745.05, 483.1, 763, 52/489.1, 489.2, 774, 775, 781.5, 52/167.1–167.9

See application file for complete search history.

(56) References Cited

U.S. PATENT DOCUMENTS

| | | | | |
|---|---|---|---|---|
| 3,235,039 | A * | 2/1966 | O'Donnell | 52/235 |
| 3,693,304 | A * | 9/1972 | Shell | 52/204.1 |
| 3,900,996 | A * | 8/1975 | Yohe | 52/241 |
| 3,998,018 | A * | 12/1976 | Hodges | 52/481.2 |
| 4,018,020 | A * | 4/1977 | Sauer et al. | 52/241 |
| 4,107,887 | A | 8/1978 | Wendt | |
| 4,114,333 | A * | 9/1978 | Jones et al. | 52/265 |
| 4,454,690 | A * | 6/1984 | Dixon | 52/126.3 |
| 4,873,806 | A | 10/1989 | Jeschke | |
| 4,986,047 | A * | 1/1991 | Power | 52/238.1 |
| 5,127,760 | A * | 7/1992 | Brady | 403/230 |
| 5,170,604 | A * | 12/1992 | Hedly | 52/584.1 |

(Continued)

OTHER PUBLICATIONS

International Search Report mailed Dec. 13, 2011 Re: PCT/US2011/043659.

*Primary Examiner* — Basil Katcheves
*Assistant Examiner* — Theodore Adamos
(74) *Attorney, Agent, or Firm* — Novak Druce Connolly Bove + Quigg LLP

(57) ABSTRACT

A modular building system uses a perimeter bond beam and prefabricated wall panels to form an exterior curtain wall. The wall panels are captured within, and may move vertically inside a channel formed in the bond beam. The wall panels are quickly erected by inserting an upper edge of each panel into the channel and swinging the panel onto the foundation where it is claimed in place on the foundation.

22 Claims, 10 Drawing Sheets

(56) References Cited

U.S. PATENT DOCUMENTS

| | | | | |
|---|---|---|---|---|
| 5,359,816 | A * | 11/1994 | Iacouides | 52/274 |
| 5,425,210 | A | 6/1995 | Zafir | |
| 5,428,926 | A * | 7/1995 | Melfi | 52/71 |
| 5,669,194 | A | 9/1997 | Colasanto et al. | |
| 5,842,276 | A * | 12/1998 | Asher et al. | 29/897.32 |
| 5,950,385 | A * | 9/1999 | Herren | 52/481.1 |
| 6,125,597 | A * | 10/2000 | Hoffman et al. | 52/169.12 |
| 6,176,053 | B1 | 1/2001 | St. Germain | |
| 6,260,329 | B1 * | 7/2001 | Mills | 52/794.1 |
| 6,430,881 | B1 | 8/2002 | Daudet et al. | |
| 6,754,999 | B1 | 6/2004 | Urbanczyk | |
| 7,100,342 | B2 * | 9/2006 | Holloway | 52/782.1 |
| 7,124,545 | B1 * | 10/2006 | Poma et al. | 52/293.3 |
| 8,245,461 | B2 * | 8/2012 | Wei | 52/202 |
| 2003/0056456 | A1 * | 3/2003 | Heydon | 52/415 |
| 2003/0182886 | A1 * | 10/2003 | Parrish | 52/293.3 |
| 2003/0192276 | A1 * | 10/2003 | Heydon | 52/415 |
| 2005/0086894 | A1 * | 4/2005 | Surowiecki | 52/633 |
| 2006/0032157 | A1 | 2/2006 | Baryla et al. | |
| 2007/0163191 | A1 * | 7/2007 | Berry | 52/281 |
| 2009/0001185 | A1 * | 1/2009 | Kroll et al. | 237/60 |
| 2009/0255213 | A1 * | 10/2009 | Schwartau | 52/794.1 |
| 2011/0146181 | A1 * | 6/2011 | Traulsen et al. | 52/474 |

* cited by examiner

MODULAR BUILDING SYSTEM

TECHNICAL FIELD

This disclosure generally relates to building construction, and deals more particularly with a building system using modular components, particularly those that can tolerate earthquakes and/or high winds. The disclosure also relates to a method of constructing a building using the modular components.

BACKGROUND OF THE INVENTION

Buildings constructed from modular components are well known in the art. In one approach, modular components are assembled into sub-assemblies in a factory environment using standardized assembly techniques. The components may include room modules, wall sections, trusses and the like that are shipped to the construction site and assembled. Using this modular construction approach, a large portion of the labor, including plumbing, wiring and mechanical work, is performed in the factory using production line techniques, thereby reducing the level of skilled labor required to complete assembly of the building components at the construction site.

Another modular construction technique, often used to construct commercial buildings such as high rise buildings, employs standardized components to form exterior curtain walls on a preassembled load bearing skeletal structure or frame. The exterior curtain wall is substantially non-load bearing and functions to both satisfy esthetic requirements and seal the interior of the building against intrusion of environmental elements.

Known building constructions employing modular components essentially rely on rigid connections between building modules and components in order to achieve the required rigidity. However, these rigid connections may represent a disadvantage during seismic events and high winds which may impose extraordinary loads on the building.

Accordingly, there is a need for a modular building system that allows rapid assembly of simplified modular building components at a construction site with relatively unskilled labor. There is also a need for a modular building system that may be used to construct buildings which are stable, yet are able to withstand some flexing and movement during seismic events and high wind loads such as those produced by hurricane force winds.

BRIEF SUMMARY OF THE INVENTION

The disclosed embodiments provide a modular building system using economical components that may be assembled on a construction site using relatively unskilled labor, yet which results in a highly robust and stable building that may withstand flexing and movement due to earthquakes or hurricane force winds. The disclosed modular building system employs an exterior floating curtain wall formed of pre-fabricated modular wall panels that are inexpensive to fabricate and which may be quickly erected in the field. The curtain wall is substantially free floating, and may therefore move and/or flex independent of the building's load bearing components, thereby substantially reducing or eliminating potential telegraphed or reactive movement during earthquakes and hurricanes which may result in greater damage to the building and/or injury to its occupants. The modular components may be fabricated using inexpensive, locally available materials, making the modular building system well suited for use in building low cost structures in remote construction sites where transportation of traditional building materials to the site may be prohibitively expensive or impractical, and skilled labor may not be available.

In one embodiment, a building comprises a foundation, a substantially rigid, load bearing frame and a curtain wall. The frame includes a beam extending substantially continuously around the perimeter of the foundation, and includes at least a first channel therein. The curtain wall includes a lower edge supported on the foundation and an upper edge captured within the channel. The frame further includes a plurality of rigid posts secured to and supporting the beam on the foundation, and the channel has a substantially U-shaped cross section. The curtain wall has an upper edge disposed within the first channel and spaced below the top of the first channel to define a space within the first channel within which the wall may move vertically relative to the beam during a seismic event. The curtain wall includes a plurality of panels each including a lower edge which is clamped against the stop on the foundation. The beam may also include a second channel adjacent the first channel for receiving the vertical posts.

According to another embodiment, a building comprises at least a first set of load bearing vertical posts adapted to be supported on a foundation, a substantially rigid beam, and at least a first curtain wall. The beam includes first and second channels extending substantially continuously around the perimeter of the foundation, wherein the upper ends of the vertical posts in the first set are received within the first channel and are secured to the beam. The curtain wall includes a plurality of modular wall panels arranged substantially end-to-end around the perimeter of the foundation. Each of the panels has a lower edge supported on the foundation and an upper edge captured within the second channel. Retainers are used to draw the wall panels against the posts. The building may further comprise a floor spaced above the foundation, and the beam may include a third channel for receiving and supporting edges of the floor. The building may also include a second set of load bearing vertical posts supported on the beam, and the beam may include a fourth channel for receiving the lower ends of the posts in the second set thereof.

According to still another embodiment, a method is provided of constructing a building, comprising erecting a rigid frame including a bond beam over a foundation, pre-fabricating a plurality of modular wall panels, and erecting each of the wall panels to form an exterior curtain wall. Erecting the wall panels is performed by tilting each of the wall panels, inserting an upper edge of the tilted panel into a channel on the bond beam, and swinging a lower edge of the panel onto the foundation.

BRIEF DESCRIPTION OF THE DRAWINGS

FIG. 25 is a flow diagram illustrating a method of constructing a building using the disclosed modular building system.

DETAILED DESCRIPTION OF THE INVENTION

Figure 1:
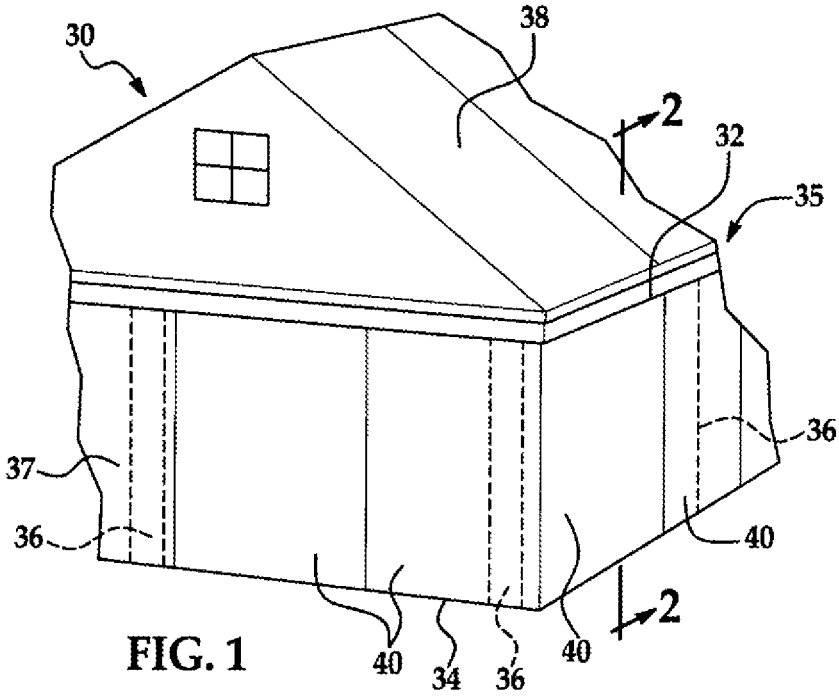
FIG. 1 is a perspective view of a section of a building constructed using the disclosed modular building system.

Referring first to FIG. 1, the disclosed embodiments relate to a modular building system for constructing a building 30. While a single story building 30 is shown in FIG. 1, the disclosed modular building system may be employed in constructing multi-storied buildings as well. The building 30 comprises a load bearing skeletal structure or frame 35, and a non-load bearing, outer curtain wall 37 formed by a plurality of modular wall panels 40 arranged end-to-end with each other. The frame 35 comprises a bond beam 32 which extends substantially continuously around the entire parameter of the building 30, secured to and supported by a plurality of spaced apart vertical posts 36 which support both the dead and live weight on the building 30. The posts 36 are secured to and are supported on around a foundation 34, which may comprise a concrete slab. As will be discussed in more detail below, the bond beam 32 as well as the posts 36 may comprise any of a variety of rigid materials, and in one embodiment may be formed of steel or iron components that are bolted and/or welded together to form a frame 35 that is both rigid and unitized, yet may twist and/or flex to some degree during seismic events or extremely high winds without substantial damage, thereby maintaining the fundamental structural integrity of the building 30.

Figure 2:
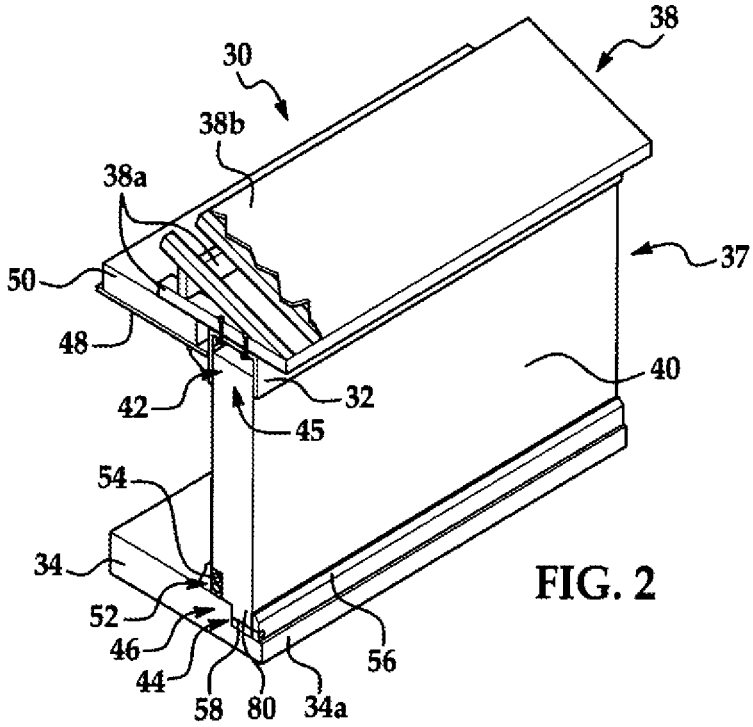
FIG. 2 is a perspective view of a portion of the building shown in FIG. 1, illustrating the connections between a curtain wall panel and foundation and roof.

Referring now also to FIG. 2, in one embodiment, the bond beam 32 comprises a U-shaped, downwardly turned channel 42 in which the upper edge 45 of each of the wall panels 40 is trapped or captured but yet may travel vertically. In this example, the roof 38 comprises a series of rafters or roof trusses 38*a* covered by a suitable roofing material 38*b*. The roof trusses 38*a* are supported on and attached to the beam 32, as will be discussed below in more detail. An interior ceiling 48 along with suitable insulation 50 may be attached to the roof trusses 38*a*, on the interior side of the curtain wall 37. The wall panel 40 may be made of any suitable materials and may include one or more vertical or horizontal chases 52 therein for carrying utilities 54, such as electrical wires, plumbing, HVAC, etc. In the example illustrated in FIG. 2, the foundation 34 comprises concrete slab or other rigid materials, and includes a dropped sill 46 around its entire perimeter. The lower edge 80 of the wall panel 40 which may include a notch 44 that mates with the dropped sill 46. The lower edge 80 of the panel 40 is clamped against the drop sill 46 by means of a longitudinally extending, substantially rigid retainer 56. Fasteners 58 extending through the retainer 56 into the foundation 34 draw the lower edge 80 of the panel 40 against the drop sill 46, thereby rigidly attaching the lower edge 80 of the wall panel 40 to the foundation 34, and positioning the lower edge 80 so that the wall panel 40 is substantially vertical when installed.

Figure 3:
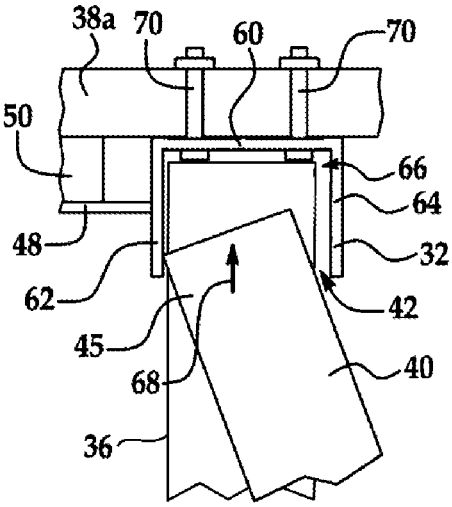
FIG. 3 is an enlarged, cross sectional view illustrating an upper edge of one of the panels as it is being inserted into the bond beam channel shown in FIG. 2.
Figure 4:
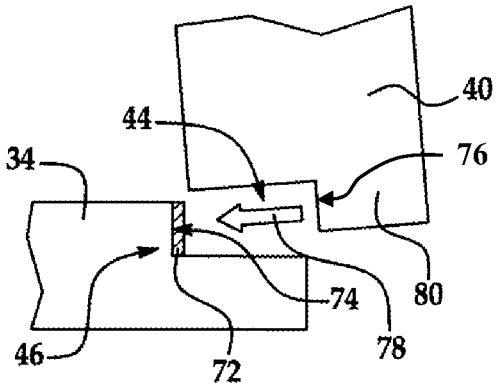
FIGS. 4 and 5A are cross sectional views showing a lower portion of the building section of FIG. 1, in which the lower edge of a curtain wall panel is being swung onto the foundation after being tilted as shown in FIG. 3.

Referring also now to FIG. 3, the beam 32 comprises a top 60 and a pair of sides 62, 64 extending downwardly from the top 60 to form the U-shaped channel 42. The roof trusses 38*a* are supported on and are secured to the beam 32 by means of fasteners 70 that pass through the roof trusses 38*a* into the top 60 of the beam 32.

Figure 5A:
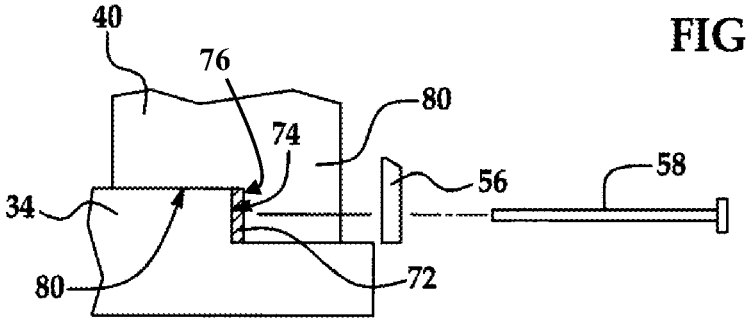
Figure 5B:
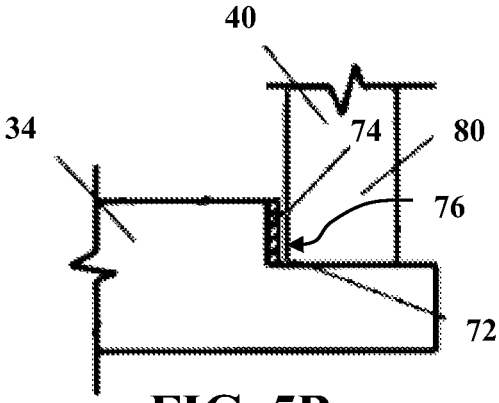
FIG. 5B is a cross sectional view of an alternate embodiment in which the panels do not have a notch and the interior side of the panels is drawn directly against the riser on the sill.

Referring now concurrently to FIGS. 3-5A, after the post and beam frame 35 has been erected on the foundation 34, the curtain wall 37 (FIG. 1) is erected by installing the individual wall panels 40 in end-to-end relationship on the foundation 34. Each of the wall panels 40 is installed by first tilting the wall panel 40, as shown in FIG. 3, and then moving the upper edge 45 of the panel 40 upwardly into the channel 42, as shown by the arrow 68. As the upper edge 45 of the wall panel 40 is moved upwardly in the direction of the arrow 68, the lower edge 80 of the wall panel 40 is swung inwardly as shown by the arrow 78 in FIG. 4, toward the dropped sill 46. As the lower edge 80 of the wall panel 40 is swung inwardly, the notch 44 in the panel 40 is brought into engagement with a riser 74 on the sill 46 which acts as an alignment stop. A suitable seal 72 which may comprise a material such as an elastomer may be placed between the riser 74 and the edge 76 in order to provide a weather tight seal between the foundation and the lower edge of the wall panel 40. With the lower edge 80 of the wall panel 40 in place, as shown in FIG. 5A, the retainer 56 may be installed using the fastener 58 in order to rigidly clamp lower edge 80 of the wall panel 40 against the riser 74 on the sill 46. It should be noted here that in other embodiments, as shown in FIG. 5B, the panels 40 may not have the notch 44, in which case the interior side of the panel 40 is drawn directly against the riser 74 on the sill 46.

Figure 6:
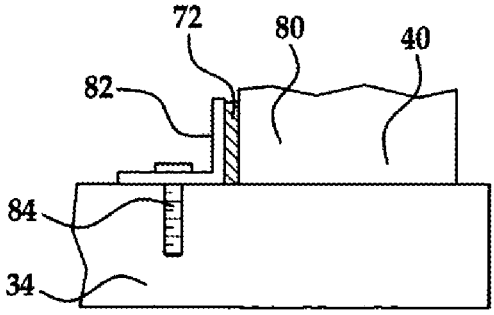
FIG. 6 is a cross sectional view of a lower edge of one of a curtain wall panel, illustrating another form of a stop for maintaining the position of the wall panel on the foundation.

Referring to FIG. 6, in some embodiments, the foundation 34 may not have a dropped sill 46, in which case an alternate form of stop such as a simple L-shaped bracket 82 may be installed on the surface of the foundation 34 by means of fasteners 84. During the installation of the panel 40, the lower edge 80 of the panel 80 is swung toward the bracket 82 which acts as a stop to vertical align and horizontally stabilize the lower edge 80 of the wall panel 40.

From the foregoing, it may be readily appreciated that relatively few fasteners and little skill are required to erect the curtain wall 37. The upper edges 45 of the wall panels 40 are held in place by virtue of being trapped inside the channel 42, while the lower edges 80 of the panels 40 are held in place by virtue of being clamped between the sill 46 and the retainer 56. It should also be noted that the curtain wall panels 40 may not pierced by any fasteners. Moreover, the curtain wall panels 40 may be made at the construction site using readily available local materials and unskilled labor.

Figure 7:
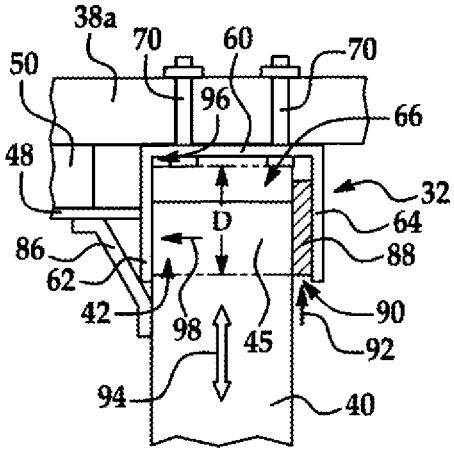
FIG. 7 is a cross sectional view similar to FIG. 3, but showing the wall panel in its installed position, a displaced position of the wall panel during an earthquake being indicated in the dashed lines.

Attention is now directed to FIG. 7 which illustrates the upper edge 45 of the wall panel 40 following its insertion into the U-shaped channel 42. In order to place the upper edge 45 of the panel 40 into the channel 42 during the installation process, it is necessary that the width of the channel 42 be greater than that of the wall panel 40. Consequently, prior the installation, a gap 90 is present between one or both of the sides 62, 64 of the beam 32 and the sides of the panel 40. In order to both stabilize the upper edge 45 of the panel against horizontal movement and create a substantially air/weather tight seal, a filler is inserted, as shown at 92 into the gap 90 in order to fill the space between the wall panel 40 and the sides 62, 64 of the beam 32. The filler 88 may comprise a waterproof, compliant and compressible material such as an elastomer or a rubber which fills and seals the gap 90 and biases the panel 40 horizontally, as shown by the arrow 98 against the opposite side 62 of the beam 32, thereby stabilizing the upper edge 45 of the panel 40 against horizontal movement. The filler 88 may be held between the panel 40 and the beam 32 by means of friction fit, or an adhesive (not shown) may be applied between the filler 88 and the beam side 64 to aid in retaining the filler 88. The interior side 62 of the beam 32 may be covered, for aesthetic purposes by a cove molding 86

Although stabilized against horizontal movement within the U-shape channel 32, the panel 40 is essentially free-floating in the vertical direction within the channel 42 as a result of a space or void 66 being provided within the channel 42 above the panel 40. During a seismic event, such as an earthquake, the panels 30 may be displaced vertically, as shown by the arrows 94 along with portions of the foundation 34 which may rise or heave unevenly, though a maximum distance D which is determined by the height of the channel sides 62, 64. Thus, during a seismic event of high winds, the frame 35 may twist and/or flex yet retain the overall structural integrity of the building, while the curtain wall panels 40 may be individually displaced vertically where required so as to accommodate uneven vertical movement of the foundation 34.

Figure 8:
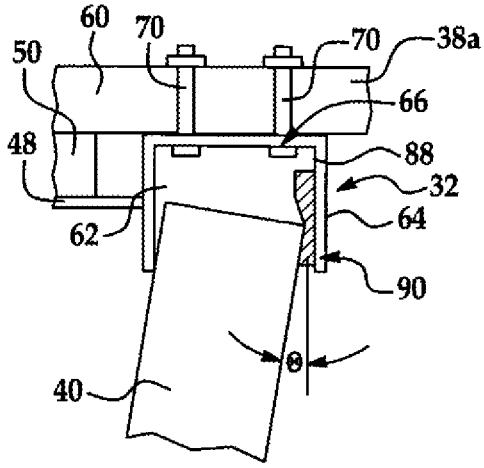
FIG. 8 is a cross sectional view similar to FIG. 7, but illustrating canting of the wall panel relative to the bond beam during a seismic or high wind event.

FIG. 8 illustrates another feature of the modular wall system that may be useful in resisting damage to the building 30 caused by seismic events or high wind loads such as those produced by hurricanes. Although the filler 88 substantially immobilizes the upper edge of the panel 40 against horizontal movement during normal conditions, the compressible nature of the filler 88 allows slight angular displacement of the upper edge 45 of the panel 40 within the channel 42 through an angle θ.

Figure 9:
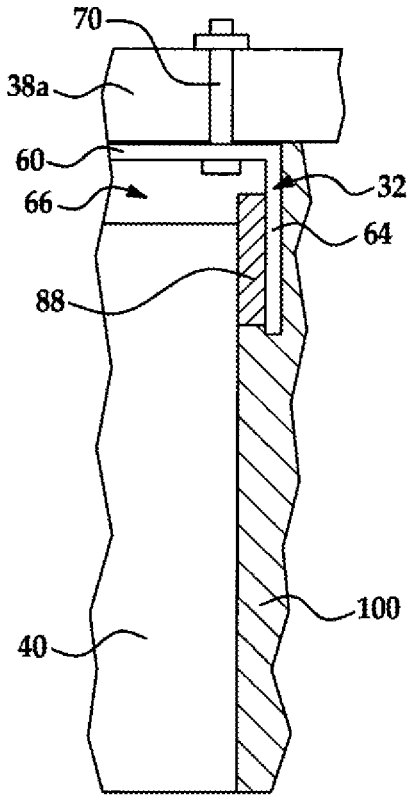
FIG. 9 is a cross sectional view of a portion of the upper edge of the wall panels, and illustrating a filler used to fill a gap between the wall panel and the bond beam channel, wherein a layer of stucco other covering material been applied to the exterior of the curtain wall.

FIG. 9 illustrates the use of a layer of vernacular material 100 such as a stucco that may be applied to the exterior surface of the wall panels 40 and which may covers the exposed sides 64 of the beam 32.

Figure 10:
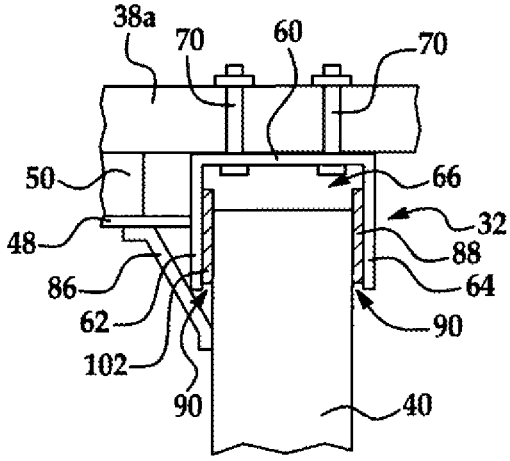
FIG. 10 is a cross sectional view similar to FIG. 7, but showing the use of a pair of fillers forming seals between both side of the panel and the bond beam.

FIG. 10 illustrates another variation in which two fillers 88, 102 are respectively placed on opposite sides of the wall panel 30 in order to fill the gaps 90. The use of fillers 88, 102 on both sides of the panel 40 may improve the water tightness of the seal between the beam 32 and the wall panel 40.

Figure 11:
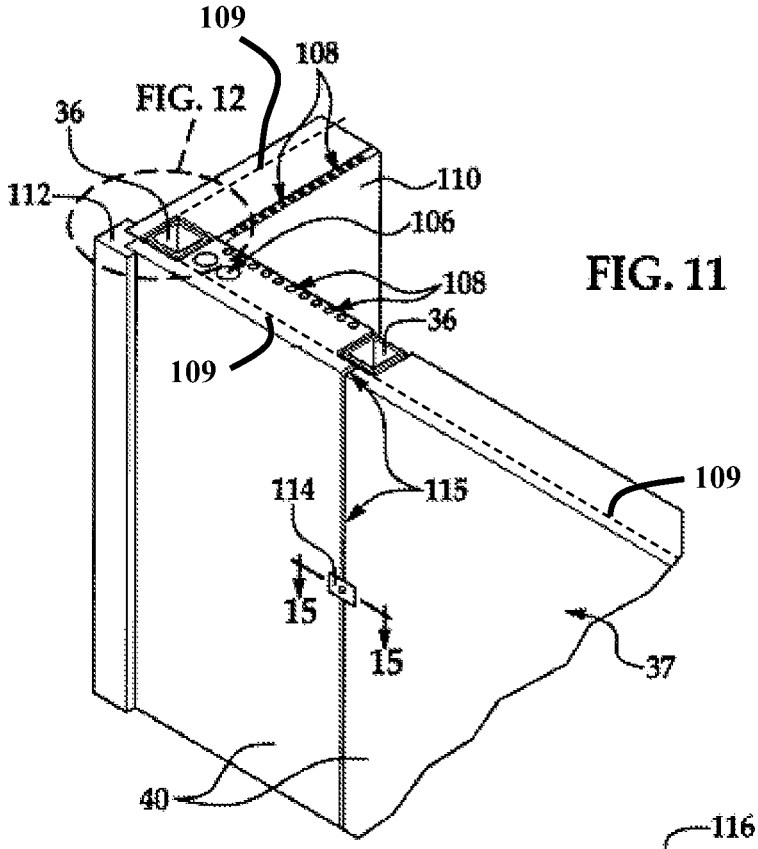
FIG. 11 is a perspective view showing wall panels intersecting at a corner of the building shown in FIG. 1.

Referring now to FIG. 11 the wall panels 40 are arranged end-to-end in order to form the curtain wall 37. The panels 40 are generally aligned with the post 36 and partially overlap each of the posts 36. The facing ends of adjacent panels 40 form a vertical butt joint 115 between the panels 40 that extends along substantially their entire height. Although not shown in the Figures, a seal or caulking maybe introduced between the panels 40 along the butt joint 115 to seal out air and moisture. The panels 40 are drawn and retained against the posts 36 by means of retainers 114 which will be discussed below in more detail. Retainers 114 extend through the vertical butt joints 115, between the panels, allowing the panels 40 to move vertically (along with the foundation 34) relative to the retainers 114 and the posts 36. One or more of the wall panels 40 may include vertical (as well as horizontal) chases 106 formed integrally therein through which utilities such as plumbing or electrical wires may be wounded.

The embodiment of FIG. 11 shows the wall panels encapsulating posts 36. In other embodiments, as shown below with respect to FIGS. 19-21, no such encapsulating is provided and the interior side of panels 40 (indicated by dotted line 109) can rest against posts 36.

The wall panels 40 may further include integrally formed fluid conduits 108 near the interior surfaces thereof for use in circulating a cooling or heating medium through the curtain wall 37. For example, relatively cool water from an underground well (not shown) may be circulated through the conduits 108 in order to cool the interior of the building 30. Alternatively, the fluid conduits 108 may be placed in an interior wall board 110 or similar wall covering on the inside surfaces of the wall panels 40. A suitable vertical coin 112 made of any suitable material, such as a combination of cement and an elastomer, may be applied to the corners of the building 30 in order to seal the corners against the intrusion of environmental elements, and/or for aesthetic purposes.

Figure 13:
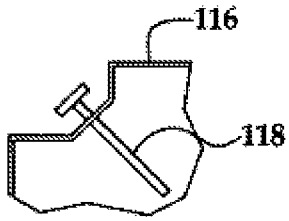
FIG. 13 is a plan view of a bracket used to attach two of the wall panels to a post at the corner shown in FIGS. 11 and 12.
Figure 12:
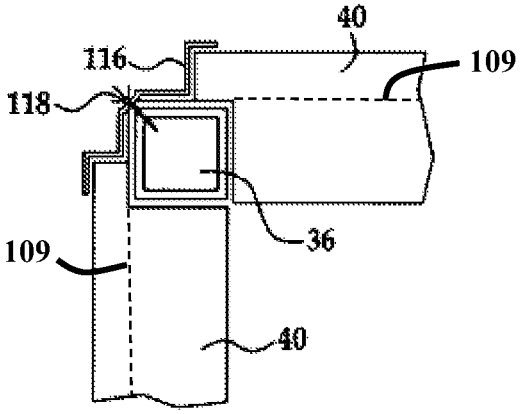
FIG. 12 is a cross sectional view showing the intersection of two wall panels at the corner of the building shown in FIG. 1.
Figure 14:
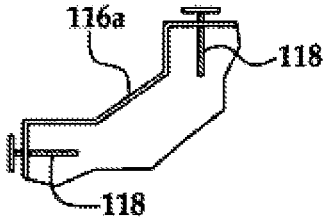
FIG. 14 is a plan view of an alternate form of the bracket.

FIGS. 12 and 13 illustrate additional details of the building corner shown in FIG. 11. As best seen in FIG. 12, each of the panels 40 partially overlaps the corner post 36 and is held against the post 36 by means of a metal bracket 116 and fasteners 118. The bracket 116 overlaps edges of each of the panels 40 and clamps the panels 40 to the post using the fastener 118. However, the bracket 116 may not clamp the panels 40 so tightly against the post 36 that the panel 40 cannot move vertically, thus allowing the panels 40 to float within the channel 42 of the beam 32. FIG. 14 illustrates an alternate form of the bracket **116*a* which is secured to the panels 40 by means of fasteners 118 which also serve to clamp the bracket 116*a* against the corner post 36**.

Figure 15:
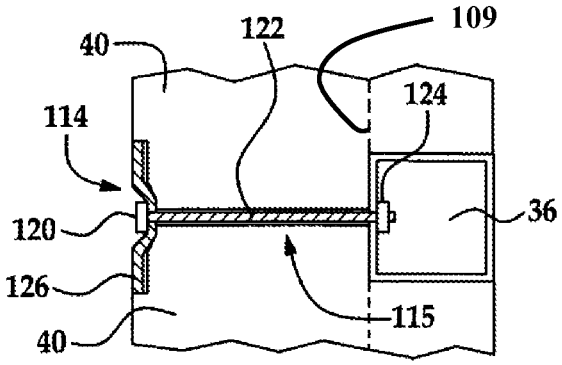
FIG. 15 is a sectional view of the mid-panel fastener taken along the line 15-15 in FIG. 11.

FIG. 15 illustrates additional details of one of the mid-panel retainers 114 shown in FIG. 11. Each of the retainers 114 comprises a threaded shank 122 fastened extending between adjacent panels 40 and a head 120 surrounded by a recessed plate 126 which acts as a washer to distribute the load applied to the panel by the retainer 114. The threaded shank 122 passes into a post 36 along the butt joint 115 between the panels 40 and is secured to the post 36 by means of a nut 124.

Figure 16:
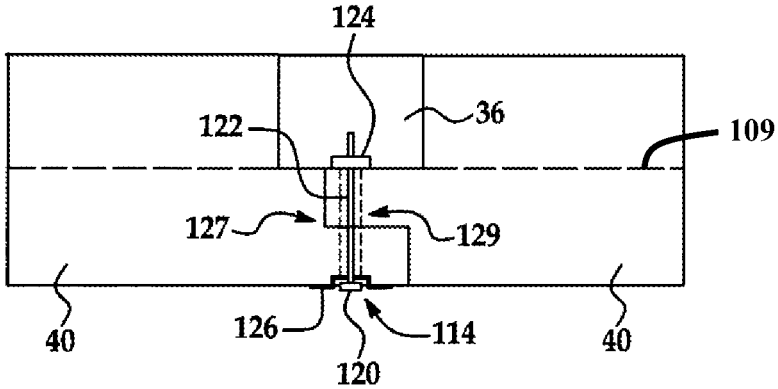
FIG. 16 is a plan view of two adjacent curtain wall panels showing an alternate joint and retainer arrangement.
Figure 17:
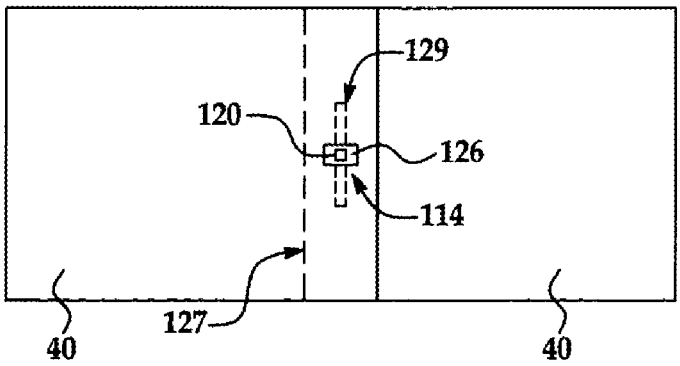
FIG. 17 is a front view of the panels shown in FIG. 16.

FIGS. 16 and 17 illustrate another curtain wall arrangement in which adjacent wall panels 40 overlap and interlock with each other through a vertical lap joint 127. The lap joint 127 assists in providing the wall 37 with lateral stability and in resisting intrusion into the building of environmental elements. In this embodiment, the overlapping portions of the panels 40 are drawn against the post 36 by the retainer 114. The panels 40 include mutually aligned vertical slots 129, and the fasteners 122 extend though the slots 129 and are secured to the post 36. The slots 129 allow the panels 40 to move vertically relative to retainer 114 during seismic events.

Figure 18:
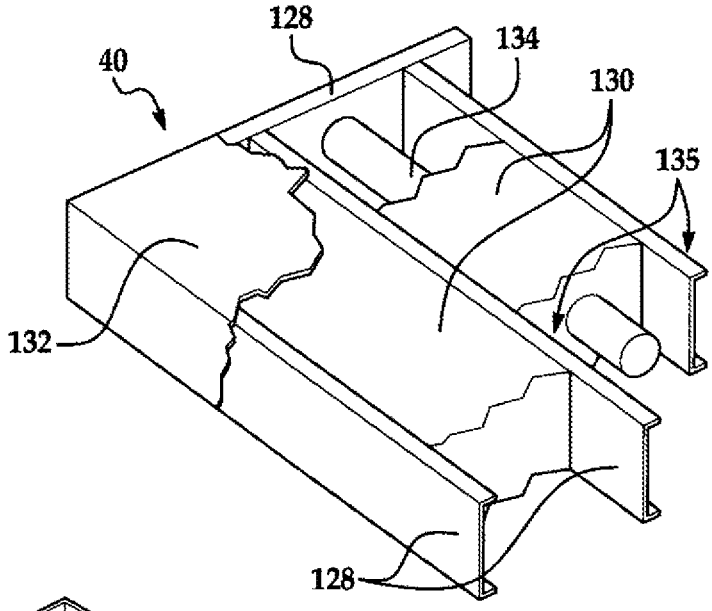
FIG. 18 is a perspective view of a typical curtain wall panel, broken away in section to show its component parts.

As previously mentioned, the modular curtain wall panels 40 may be prefabricated using any of numerous construction details and materials. FIG. 18 illustrates one embodiment of a wall panel 40 suitable for use in the disclosed modular floating system. The wall panel 40 comprises an internal frame structure comprising rigid frame members 128 which may comprise, for example and without limitation, metal studs commonly used in the building industry. Spaces 135 between the frame members 128 may be filled with a rigid, insulating foam 130 such as polyurethane, or other lightweight insulating material. One or more chases 134 may be included in the wall panel 40 to allow utilities such as plumbing and electrical wires to be routed through the panel 40. The panel 40 is encapsulated with an outer layer 132 of a suitable material such as a concrete or an epoxy or a combination of concrete and polymer materials which substantially seal the interior of the panel 40 against the intrusion of local environmental elements. The panel construction shown in FIG. 18 is illustrative of a wide range of possible modular constructions.

Figure 19:
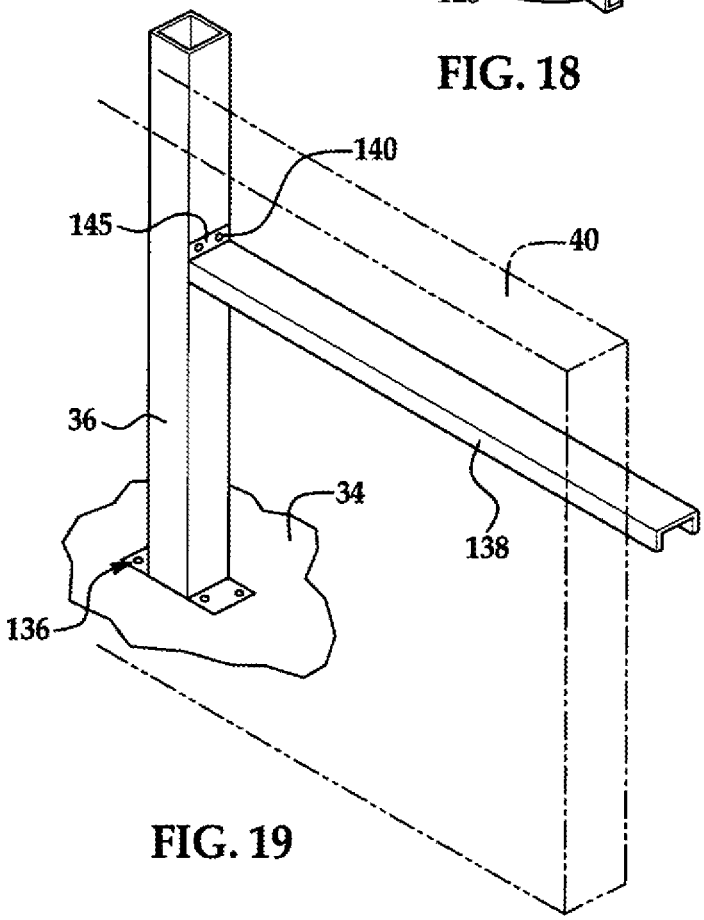
FIG. 19 is a perspective view of a mid-level horizontal reinforcement, a wall panel being indicated in the phantom.

Referring to FIG. 19, in some embodiments, it may be necessary or desirable to provide a mid-panel support 138 that extends horizontally between adjacent posts 36 and is fastened thereto by means of either fasteners 140 that pass through flanges 145 on the post 36, or by weldments (not shown). The support 138 provides lateral bracing for the wall panels 40, when needed, while also providing a structure into which interior wall panels such as drywall (not shown) may be fastened. The wall panels 40 may also be mechanically attached to the mid-level supports 138 by fastener (not shown) which allow the wall panels 40 to move vertically to some degree. In the example shown in FIG. 19, the posts 36 are secured to the foundation by means of flanges and fasteners 136, however in other embodiments, the posts 36 may be embedded into the foundation 34.

Figure 20:
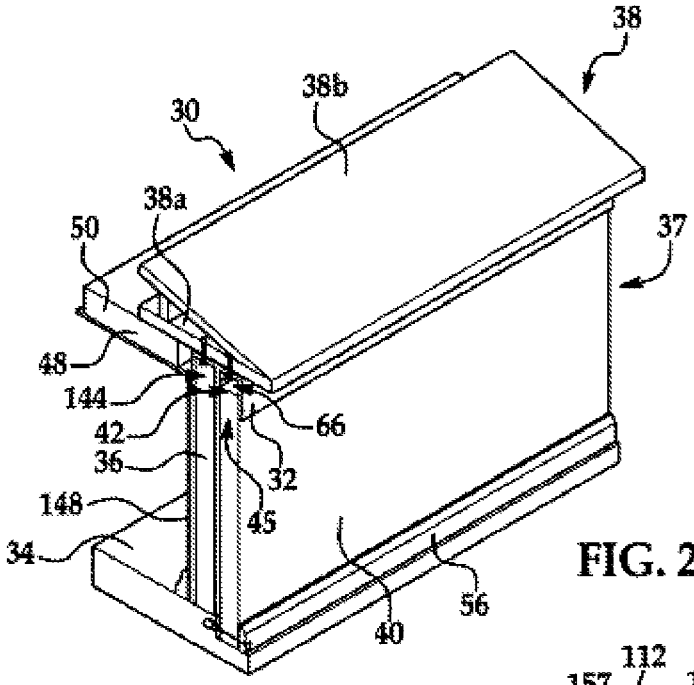
FIG. 20 is a perspective view similar to FIG. 2, but showing a double wall embodiment of the modular building system.
Figure 21:
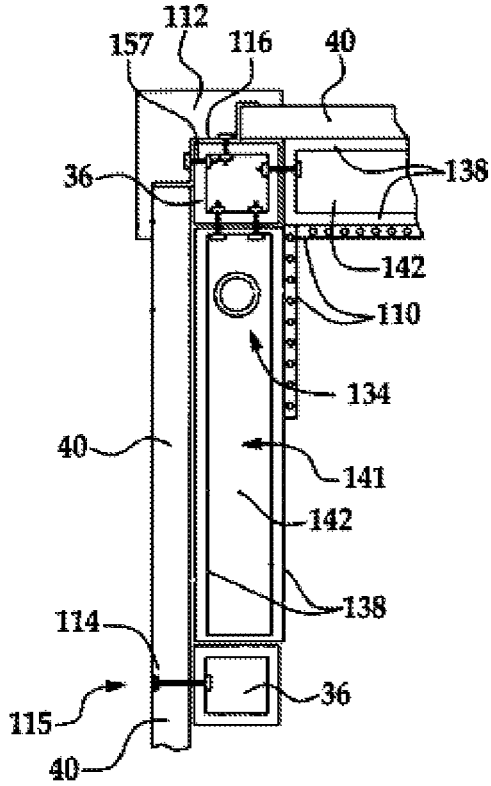
FIG. 21 is a horizontal sectional view of a corner of a building employing the double wall embodiment shown in FIG. 20.

Attention is now directed to FIGS. 20 and 21 which illustrate another embodiment of the modular building system which will sometimes be referred to herein as a double wall system. This embodiment is similar to embodiments previously discussed, but wherein an inner cavity wall system 141 is provided that comprises walls 110 on the interior side of the posts 36. The walls 110 are spaced inwardly from the curtain wall panels 40 to form cavities 142 between the posts 36. The walls 110 may be formed of any suitable materials such as without limitation, wallboard. The walls 110 may be stabilized by and secured to mid-panel supports 138 which extend horizontally between and are secured to the posts 36.

In this embodiment, as best seen in FIG. 20, the bond beam 32 has a W-like cross sectional shape defining an outer channel 42 and an inner channel 144. The outer channel 42 receives the upper edge 45 of the curtain wall panels 40, while the inner channel 144 receives the upper ends of the posts 36. The curtain wall panels 40 "float" within the outer channel 42 on the bond beam 32, as in the previously discussed embodiments. Referring particularly to FIG. 21, in this double-wall embodiment, the curtain wall panels 40 are disposed immediately outside of the posts 36 and are clamped thereaginst along the vertical butt joints 115 or lap joints 127 (FIGS. 16 and 17) by means of retainers 114. The cavities 142 may be substantially or partially hollow, or may contain insulation (not shown), sound deadening materials, and/or utilities, including one or more chases 134 for routing of utilities. The walls 110 may be provided with fluid conduits 108 that circulate warm or cool fluids such as water near the interior surfaces of the walls 110 in order to heat and/or cool interior rooms of the building 30. Curtain wall panels 40 intersecting at the corners of the building 30 are clamped against the corner posts 36 by means of brackets 116, similar to previously described embodiments, and fasteners 157. The corner may be covered with a vertically extending coin 112, as in previous embodiments.

Figure 22:
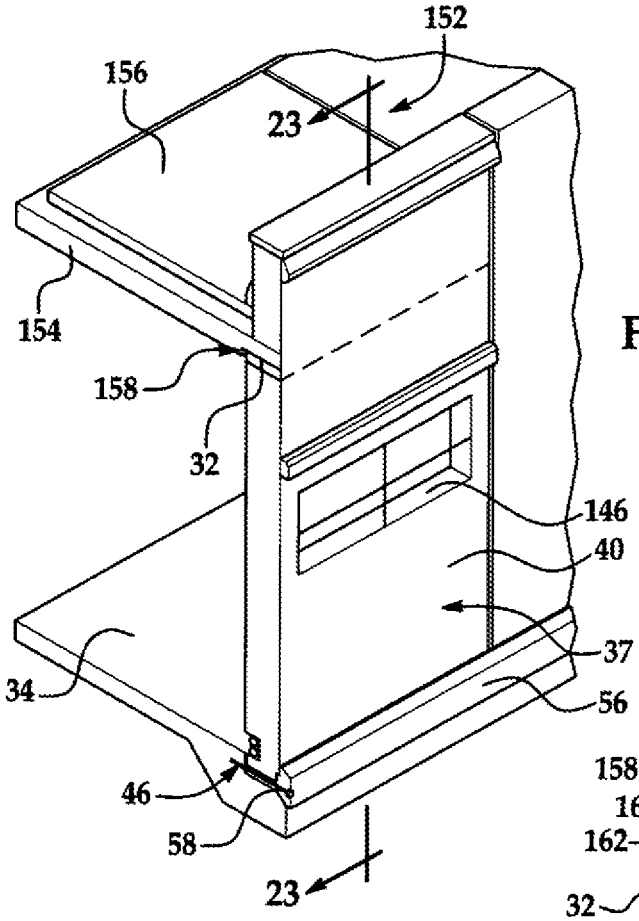
FIG. 22 is a perspective view of another embodiment of the modular building system in which a flat roof panel is supported on a bond beam.
Figure 23:
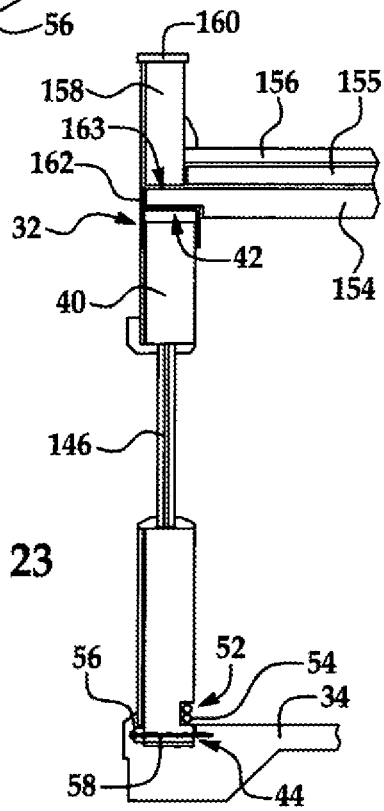
FIG. 23 is a sectional view taken along the line 23-23 in FIG. 22.

Attention is now directed to FIGS. 22 and 23 which illustrate a further embodiment of the modular building system having outer curtain walls 37 formed by free floating curtain wall panels 40 of the type previously discussed. In this embodiment, however, the building has a substantially flat roof 152 which may comprise, for example and without limitation, a flat, precast and reinforced roof panel 154 or concrete poured over a pan (not shown) covered by rigid insulation 155 and a membrane cap 156 that may comprise an aerated concrete cap or a membrane cap (not shown). A parapet 158 and associated membrane cap 160 are supported on the outer edges 163 of the roof panel 154. In this embodiment, the bond beam 32 has a generally U-shaped channel 42 for receiving the upper edge of the curtain wall panels 40, similar to the embodiments previously described. However, the bond beam 32 includes a vertical leg or side wall 162 near the outer edge of beam 32 which acts as a stop that engages the outer edges of the roof panel 154 supported on top of the bond beam 32. The vertical leg 162 may extend upwardly beyond the position shown in the Figures to provide additional support for the parapet 158. In this example, the curtain wall panel 40 is shown as having a window 146 therein, but in other respects it may be similar to the wall panels 40 previously described.

Figure 24:
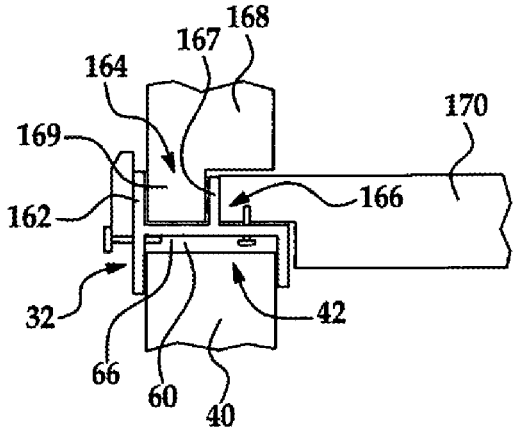
FIG. 24 is a sectional view illustrating an alternate form of the bond beam suitable for supporting second story wall panels.

FIG. 24 shows an alternate form of the bond beam 32 which is generally similar to the bond beam 32 shown in FIGS. 22 and 23 except that another leg 167 is provided that forms a second U-shaped channel 64 that is directed upwardly and is adapted to receive the lower edge 169 of a second story curtain wall panel 168 or a parapet 158 (FIG. 23). Also, in this example, a second story floor 170 (or roof panel 154) is supported on the bond beam 32, along the outer edge 166 of the floor 170.

Figure 25:
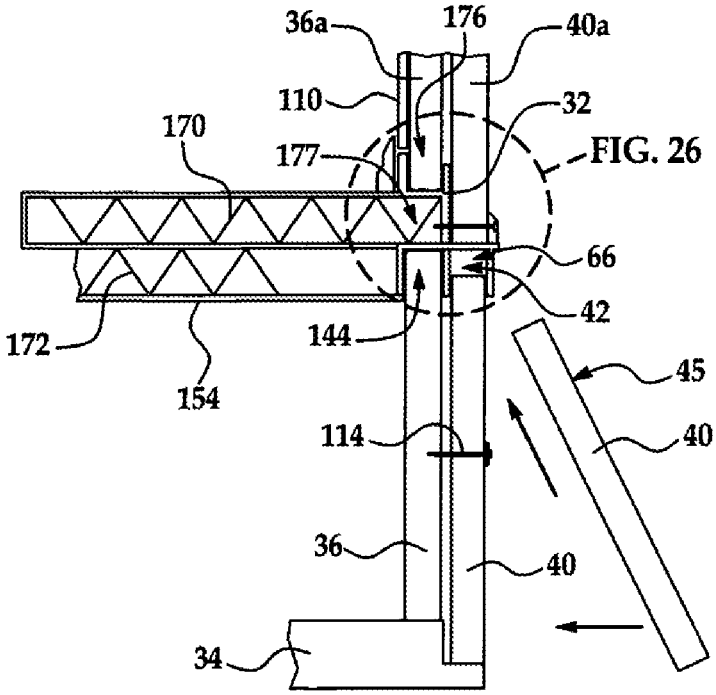
FIG. 25 is a vertical sectional view of another embodiment of the modular building system showing the use of double walls in a two story building.
Figure 26:
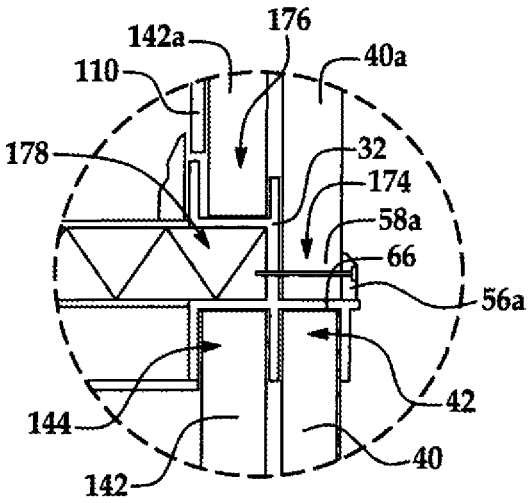
FIG. 26 is an enlarged view of the area designated as FIG. 26 in FIG. 25.

FIGS. 25 and 26 illustrate still another embodiment of the modular building system. This embodiment, which may be referred to as a double wall, two story construction, employs a bond beam 32 having four U-shaped channels 42, 144, 176, 177. Channels 42 and 144 open downwardly, while channel 176 opens upwardly and channel 177 opens laterally toward the interior of the building 30. Channel 42 receives the upper edge 45 of the curtain wall panels 40, with a gap or open space 66 being present at the top of channel 42 above the panels 40, similar to previously described embodiments. Channel 144 receives the top of the first story posts 36, while channel 176 receives the bottom of second story posts **36*a*. The first and second curtain wall panels 40, 40*a* respectively, are disposed immediately outside the posts 36, 36*a*. The spaces (not shown) between the posts 36, 36*a*, when covered by interior wall board 110 or the like, form first and second story cavity walls inboard of the curtain wall panels 40, 40***a*. Edges of a second story floor 170 are received and supported within the channel 177. The first story may include a ceiling panel 154 and suitable insulation 172, similar to the previously described embodiments. The second story curtain wall panels 40*a* are supported on and may be secured to the bond beam 32 by means of a retainer 56*a* and fasteners 58*a* that pass through joints (not shown) between the panels 40*a* and are secured to the beam 32.

Figure 27:
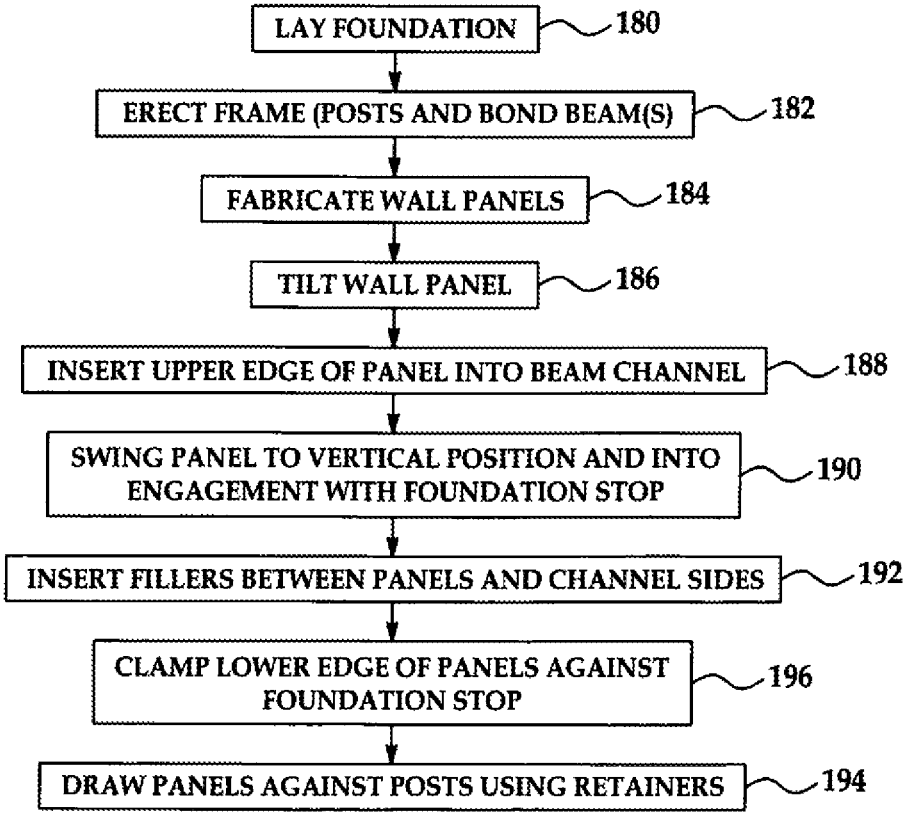

FIG. 27 illustrates the steps of a method of constructing a building using the disclosed modular building system. Beginning at 180, the foundation 34 is laid, following which at 182 the posts 36 and bond beams 32 are erected using bolts, rivets or by welding. In some embodiments, the posts 36 may be embedded into the foundation 34 during step 180. Next, at 184 the wall panels 40 are fabricated following which they may be tilted at 186 before being inserted into the beam channels 42 at step 188. As the wall panels 40 are being inserted into the U-shaped channels 42, the panels 40 are swung to their vertical position, and into engagement with a stop on the foundation 34. At 192, fillers 88 may be inserted between the upper edges 45 of the wall panels 40 and the sides 62, of the channel 42. Alternatively, fillers may be attached to the upper edges 45 of one or both sides of the wall panels 40 before they inserted into the bond beam channel 42. Then at 194, the lower edges of the panels 40 are clamped against the foundation stops by means of retainers 56 and fasteners 58. Finally, at 196, the panels 40 may be drawn and retained against the posts 36 using the mid-panel retainers 114.

Although the embodiments of this disclosure have been described with respect to certain exemplary embodiments, it is to be understood that the specific embodiments are for purposes of illustration and not limitation, as other variations will occur to those of skill in the art.

What is claimed:

1. A building, comprising:

a foundation comprising a stop;

a substantially rigid, load bearing frame supported by the foundation, the frame including a beam comprising at least a first channel therein that is downwardly turned and a plurality of posts supporting the beam;

a curtain wall having a lower edge supported on the foundation, and an upper edge captured within the first channel, the curtain wall comprising a plurality of wall panels;

at least one first retainer disposed on an outer surface of the curtain wall and attached to the foundation; and at least one second retainer comprising a plate for drawing the curtain wall against the plurality of posts and at least one fastener attaching the plate to at least one of the plurality of posts, wherein the lower edge of the curtain wall is captured between the at least one first retainer and the stop, and wherein the curtain wall is free-floating in at least the vertical direction with respect to at least the load bearing frame once the at least one first retainer and the at least one second retainer are in place, wherein portions of adjacent ones of the plurality of wall panels overlap each other and one or more pairs of mutually aligned vertical slots defining a passage through each of the adjacent ones of the plurality of wall panels, and wherein the at least one fastener for at least one of the at least one second retainer passes through one of the pairs of mutually aligned vertical slots, the pairs of mutually aligned vertical slots allowing the adjacent ones of the plurality of wall panels to move vertically relative to the at least one fastener.

2. The building of claim 1, wherein the first channel has a substantially U-shaped cross section.

3. The building of claim 2, wherein:

the first channel includes a top and spaced apart sides, and the curtain wall has an upper edge disposed within the first channel and spaced below the top of the first channel to define a space within the first channel within which the wall may move vertically relative to the beam.

4. The building of claim 3, wherein:

the wall has a width, and the width of the wall is less than the distance between the sides of the first channel, defining a gap between the wall and the sides of the first channel that allows the curtain wall to tilt within the first channel when the at least one first retainer is removed.

5. The building of claim 4, further comprising:

at least one filler in the gap for laterally stabilizing the curtain wall within the first channel and for forming a seal between the wall and the beam.

6. The building of claim 2, wherein the beam includes a second channel adjacent the first channel, and wherein upper ends of the plurality of posts are received within the second channel.

7. The building of claim 1, wherein the foundation further comprises a sill, and wherein the stop is defined by a riser on the sill.

8. The building of claim 1, wherein the foundation further comprises at least one L-shaped bracket attached thereto and having a portion extending from the foundation, and wherein the portion extending from the foundation defines the stop.

9. The building of claim 1, further comprising at least one bracket attached to at least one post of the plurality of posts and overlapping a portion of the outer surface of the curtain wall to clamp the curtain wall to the at least one post, wherein the bracket, the at least one post, and the curtain wall are arranged so that the curtain wall remains free-floating in at least the vertical direction with respect to the bracket.

10. A building, comprising:

a foundation comprising a stop;

a first set of load bearing vertical posts adapted to be supported on the foundation;

a substantially rigid beam including at least one channel, wherein upper ends of the vertical posts in the first set are received within the at least one channel and are secured to the beam;

a first curtain wall including a plurality of modular wall panels arranged substantially end-to-end, each of the plurality of modular wall panels having a lower edge supported on the foundation and an upper edge captured within the at least one channel;

at least one first retainer disposed on an outer surface of the first curtain wall and attached to the foundation; and at least one second retainer comprising a plate for drawing at least one of the panels from the plurality of modular wall panels against at least one of the vertical posts and at least one fastener attaching the plate to the at least one of the vertical posts, wherein the lower edge of the curtain wall is captured between the at least one first retainer and the stop, and wherein the curtain wall is free-floating in at least the vertical direction with respect to at least the load bearing vertical posts once the at least one first retainer and the at least one second retainer are in place, wherein portions of adjacent ones of the plurality of modular wall panels overlap each other and one or more pairs of mutually aligned vertical slots defining a passage through each of the adjacent ones of the plurality of modular wall panels, and wherein the at least one fastener for at least one of the at least one second retainer passes through one of the pairs of mutually aligned vertical slots, the pairs of mutually aligned vertical slots allowing the adjacent ones of the plurality of modular wall panels to move vertically relative to the at least one fastener.

11. The building of claim 10, wherein the ends of the vertical posts are located within the beam inboard of the plurality of modular wall panels.

12. The building of claim 10, wherein at least one of the plurality of modular wall panels include a plurality of conduits therein adapted to circulate a liquid for heating or cooling the interior of the building.

13. The building of claim 10, further comprising:

a wall inboard of the vertical posts and forming cavities between adjacent one of the vertical posts.

14. The building of claim 10, further comprising:

a floor spaced above the foundation, and wherein the beam includes a third channel for receiving and supporting edges of the floor.

15. The building of claim 14, further comprising:

a second set of load bearing vertical posts supported on the beam, and wherein the beam includes a fourth channel for receiving the lower ends of the posts in the second set thereof.

16. The building of claim 15, further comprising:

a second curtain wall above the first curtain wall, the second curtain wall including a plurality of curtain wall panels supported on a portion of the beam.

17. The building of claim 10, wherein each of the wall panels includes:

a frame including a plurality of substantially rigid, spaced apart frame members, an insulation medium between at least certain of the frame members, and a coating encapsulating the frame.

18. A method of constructing a building, comprising:

erecting a rigid frame over a foundation comprising a stop, the rigid frame comprising a bond beam having at least a first channel therein that is downwardly turned and a plurality of posts supporting the beam;

erecting a plurality of modular wall panels to form an exterior curtain wall by performing, for each wall panel from the plurality modular wall panels, the steps of tilting the wall panel to yield a tilted panel, inserting an upper edge of the tilted panel into the first channel of the bond beam, and swinging a lower edge of the tilted panel onto the foundation to engage the stop;

attaching at least one first retainer to the foundation such that the lower edge of each of the curtain wall is captured between the retainer and the stop; and attaching at least one second retainer comprising a plate for drawing at least one of the panels from the plurality of modular wall panels against at least one of the plurality of posts and at least one fastener attaching the plate to the at least one of the plurality of posts, wherein the attaching of at least one first retainer and the attaching of the at least one second retainer is configured to allow the at least one of the plurality of modular wall panels to be free-floating in at least the vertical direction with respect to at least the rigid frame, wherein portions of adjacent ones of the plurality of modular wall panels overlap each other and one or more pairs of mutually aligned vertical slots defining a passage through each of the adjacent ones of the plurality of wall panels, and wherein the at least one fastener for at least one of the at least one second retainer passes through one of the pairs of mutually aligned vertical slots, the pairs of mutually aligned vertical slots allowing the adjacent ones of the plurality of modular wall panels to move vertically relative to the at least one fastener to provide the free-floating.

19. The method of claim 18, wherein erecting the wall panels further includes sealing the panels to the beam by introducing a filler between the upper edge of the wall panels and the channel.

20. The method of claim 18, wherein:

erecting a rigid frame includes erecting a plurality of vertical posts on the foundation for supporting the bond beam, and erecting the wall panels includes drawing the wall panels against the posts.

21. The method of claim 18, wherein fabricating the wall panels includes integrating a plurality of fluid conduits into the panels for circulating a fluid that heats or cools the building.

22. The method of claim 18, further comprising:

attaching at least one bracket to at least one post of the plurality of posts so as to overlap a portion of the outer surface of the exterior curtain wall to clamp the exterior curtain wall to the at least one post, wherein the bracket, the at least one post, and the exterior curtain wall are arranged so that the exterior curtain wall remains free-floating in at least the vertical direction.

* * * * *